US009010892B2

(12) United States Patent
Frydman et al.

(10) Patent No.: US 9,010,892 B2
(45) Date of Patent: Apr. 21, 2015

(54) RECIRCULATION SYSTEM

(75) Inventors: Ilan Frydman, Tel Aviv (IL); Mark Sandler, Rehovot (IL); Doron Schlumm, Kfar Herif (IL); Danny Gerstenfeld, Ramat Gan (IL); Asaf Miron, Carcur (IL)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/126,457

(22) PCT Filed: Jul. 15, 2011

(86) PCT No.: PCT/EP2011/062170

§ 371 (c)(1),
(2), (4) Date: Dec. 16, 2013

(87) PCT Pub. No.: WO2013/010570

PCT Pub. Date: Jan. 24, 2013

(65) Prior Publication Data

US 2014/0125719 A1 May 8, 2014

(51) Int. Cl.

| | |
|---|---|
| ***B41J 2/195*** | (2006.01) |
| ***B41J 29/377*** | (2006.01) |
| ***B41J 2/18*** | (2006.01) |
| ***B41J 2/01*** | (2006.01) |
| ***G03G 15/10*** | (2006.01) |
| ***B41F 31/20*** | (2006.01) |

(52) U.S. Cl.

CPC *B41J 2/18* (2013.01); *B41J 29/377* (2013.01); *G03G 15/107* (2013.01); *B41F 31/20* (2013.01); *B41P 2231/20* (2013.01)

(58) Field of Classification Search

USPC ..... 347/7, 18, 89, 102

See application file for complete search history.

(56) References Cited

U.S. PATENT DOCUMENTS

| | | | | |
|---|---|---|---|---|
| 4,591,517 | A | 5/1986 | Whipple et al. | |
| 5,540,152 | A | 7/1996 | DeMoore | |
| 6,038,976 | A | 3/2000 | Helmstadter et al. | |
| 6,059,406 | A * | 5/2000 | Richtsmeier et al. | 347/102 |
| 7,850,274 | B1 | 12/2010 | Chang et al. | |
| 2009/0035023 | A1 | 2/2009 | Thompson et al. | |
| 2010/0080591 | A1 | 4/2010 | Takeuchi | |

FOREIGN PATENT DOCUMENTS

| | | |
|---|---|---|
| EP | 0858010 | 8/1998 |
| JP | 10035943 | 2/1998 |
| WO | WO-2009045168 | 4/2009 |

OTHER PUBLICATIONS

International Searching Authority, The International Search Report and the Written Opinion, Feb. 29, 2012, 11 Pages.

* cited by examiner

*Primary Examiner* — Jannelle M Lebron

(57) ABSTRACT

A method and apparatus for re-circulating a carrier in a printer is disclosed. The re-circulating system comprises a controller, a print head, a variable speed fan coupled to an air passageway and a condenser. The controller determines a liquid amount of carrier to be place on a page during a print operation. The controller adjusts the variable speed fan dependent on the amount of liquid carrier determined to be placed onto the page.

16 Claims, 5 Drawing Sheets

RECIRCULATION SYSTEM

CROSS-REFERENCE TO RELATED APPLICATION

This application is a national stage application under 35 U.S.C. §371 of PCT/EP2011/062170, filed Jul. 15, 2011.

BACKGROUND

Some printers and printing presses (hereinafter printers) use a condenser to remove heat and/or vapor(s) generated during operation. A condenser uses one or more temperature-controlled surfaces to affect the temperature of a fluid passing by the condenser. The fluid may then be re-circulated back into the printer to maintain an acceptable operating temperature of the printer.

DETAILED DESCRIPTION

FIGS. 1-6 and the following description depict specific examples to teach those skilled in the art how to make and use the best mode of the invention. For the purpose of teaching inventive principles, some conventional aspects have been simplified or omitted. Those skilled in the art will appreciate variations from these examples that fall within the scope of the invention. Those skilled in the art will appreciate that the features described below can be combined in various ways to form multiple variations of the invention. As a result, the invention is not limited to the specific examples described below, but only by the claims and their equivalents.

The example systems and apparatus described herein may be used to increase collection and/or reduce emission of vapor in, for example, a printer such as a printing press. Some example apparatus described herein include a duct to direct a mixture of air and ink carrier vapor from a printer to a condenser. The duct may couple to only a portion of the condenser. Other portions of the condenser may be used to cool air flowing through the printer, but not flowing through the duct. The duct substantially reduces or prevents air from outside the duct from diluting the ink carrier vapor in the mixture. Thus, the mixture has substantially the same concentration of ink carrier vapor as when the mixture entered the duct from the printer. The example condenser then cools the mixture, causing at least a portion of the ink carrier vapor within the mixture to condense into a liquid, which may then be collected. Collected ink carrier may be recycled. Further, collecting the ink carrier reduces the amount of ink carrier vapor that may escape from the printer. Cooled air from the condenser is then re-circulated into the printer.

The mixture of air and ink carrier vapor entering the duct may have varying concentrations of ink carrier vapor due to variations in the amount of ink used to print different pages. Reductions in the concentrations of ink carrier vapor in the flow in the duct will reduce the efficiency of the condenser. The flow of the mixture of air and ink carrier vapor in the duct is controlled by a variable speed fan. The speed of the fan is adjusted based on the amount of ink to be used for a page and the known oil to ink ratio, thereby maintaining the concentrations of ink carrier vapor in the mixture.

Figure 1:
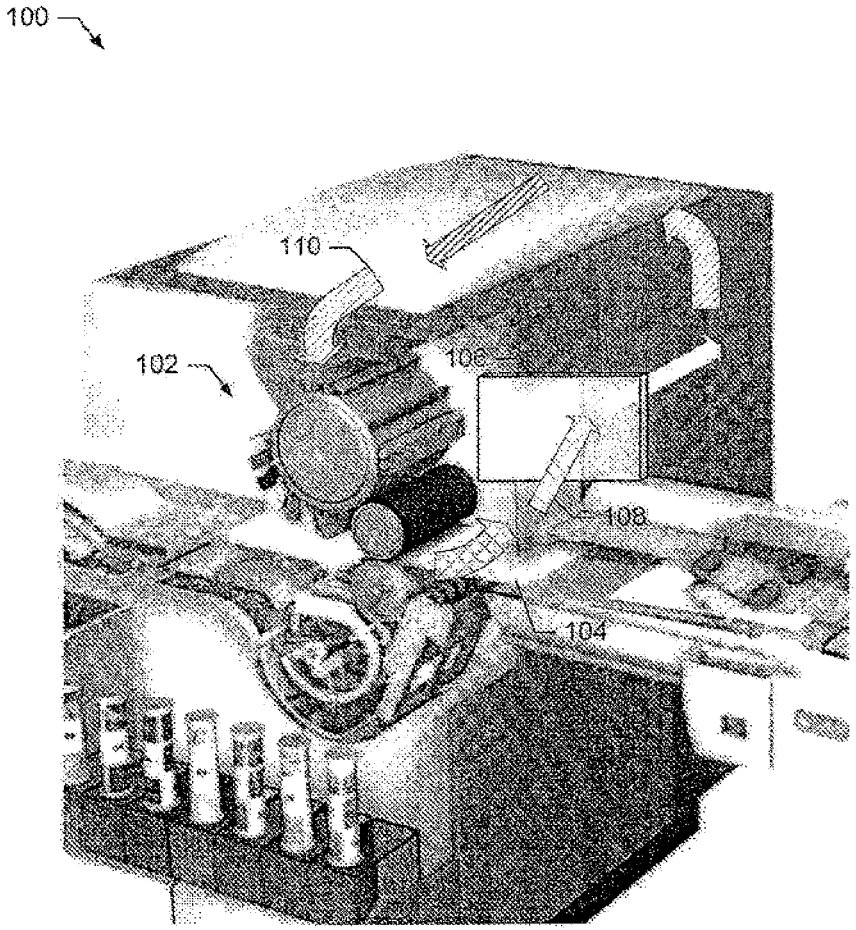
FIG. 1 depicts an example airflow cycle for a printer employing a condenser constructed in accordance with the teachings of this disclosure.

FIG. 1 depicts an example airflow cycle for a printer or printing press 100. The example printer 100 uses one or more inks that include a significant portion of ink carrier. In some examples, the ink carrier is a volatile organic compound (VOC) such as Isopar L. Emissions of many VOCs are regulated by government agencies and, thus, keeping emissions below regulation amounts is desirable. As the ink is transferred to an image transfer device 102 and to a print substrate 104 (e.g., paper), the ink carrier vaporizes into the internal air of the printer 100 and hence increases the ink carrier vapor concentration inside the printer 100, results in increase of the vapor mass emission.

Figure 2:
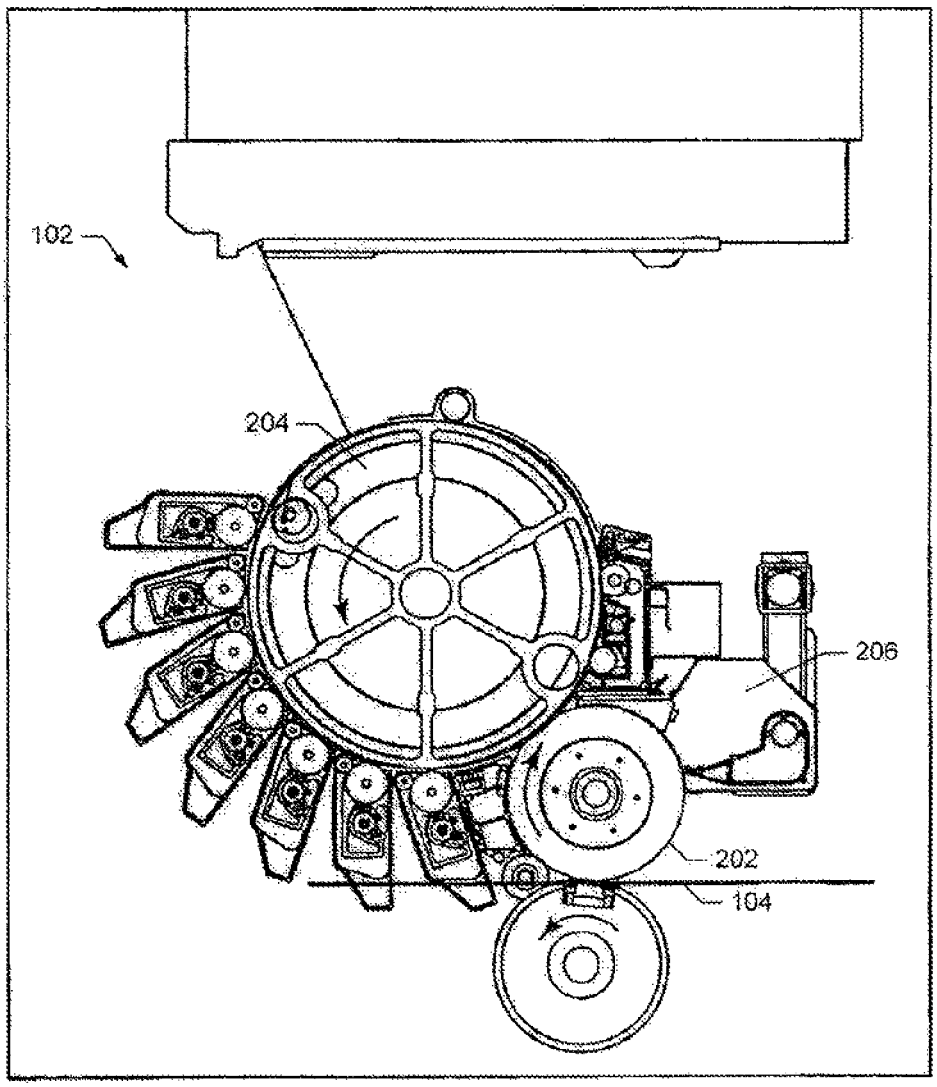
FIG. 2 depicts the example image transfer device of FIG. 1.

FIG. 2 depicts the example image transfer device 102 of FIG. 1 in greater detail. The example transfer device 102 includes a transfer member 202. The transfer member 202, also known as a blanket, receives an image of ink from a drum 204. The transfer member 202 rotates to apply the ink image to a print substrate 104 such as paper. As mentioned above, ink carrier from the ink vaporizes into the air near the transfer member 202. A hood 206 positioned near the transfer member 202 captures hot internal press air, including the vaporized ink carrier, and urges (e.g., via a blower or fan) the hot air away from the image transfer device 102 to be cleaned and/or re-circulated.

Figure 3:
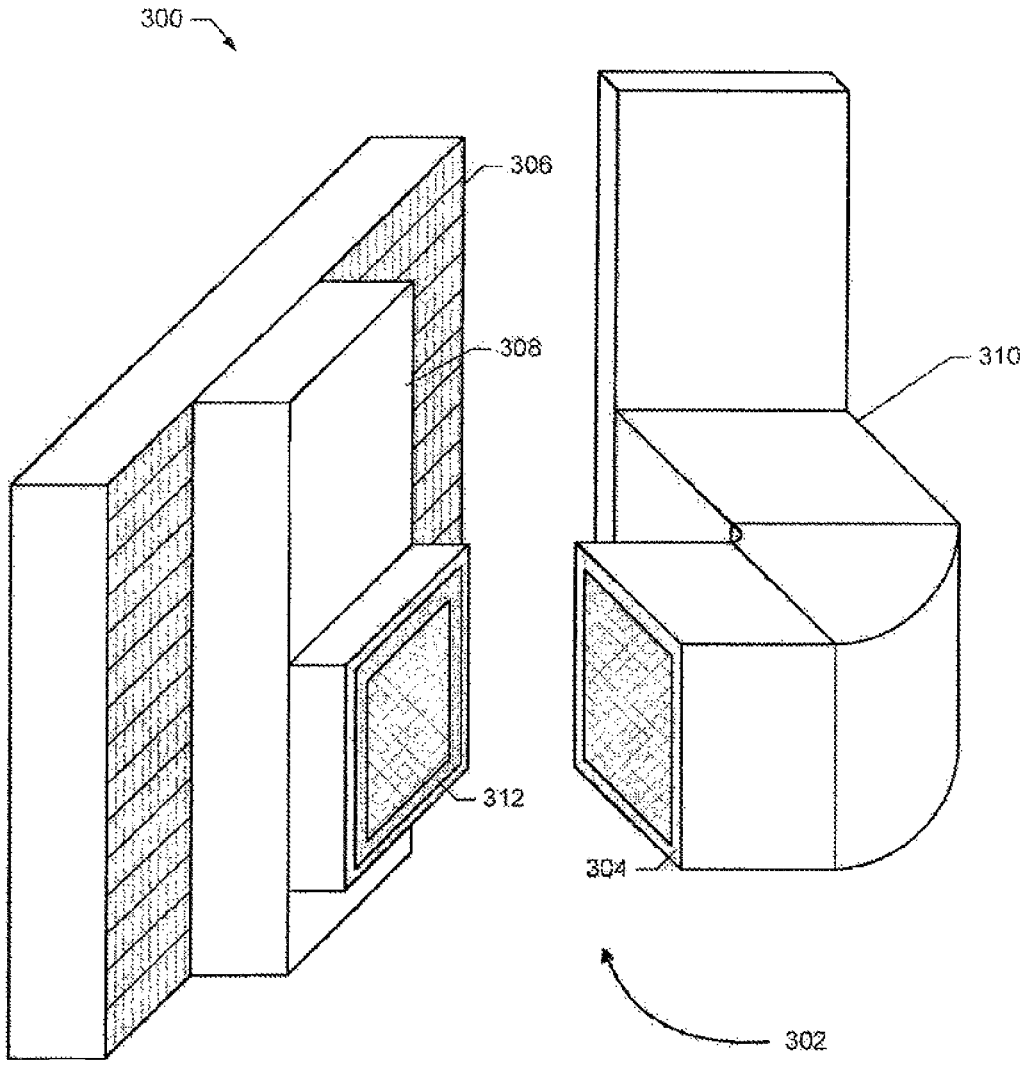
FIG. 3 is an isometric partial view of a recirculation system 300 in an example embodiment of the invention.

FIG. 3 is an isometric partial view of a recirculation system 300 in an example embodiment of the invention. The partial view of recirculation system 300 shows a duct 304 and a condenser 306. Duet 302 has two sections (308 and 310) that can be separated for access and maintenance. Section 310 has face 304 that mates with seal 312 on section 308 when duct is in the closed position. Duct section 308 is attached to, and couples with, condenser 306. Duct section 308 covers only a portion of condenser 306 and leaves the side edges of condenser open for use for an air flow independent of the air flow in the duct 302. Duct 302 is coupled to hood 206 (see FIG. 2) and creates an air passageway to direct the hot internal press air, including the vaporized ink carrier, into condenser 306.

Figure 4:
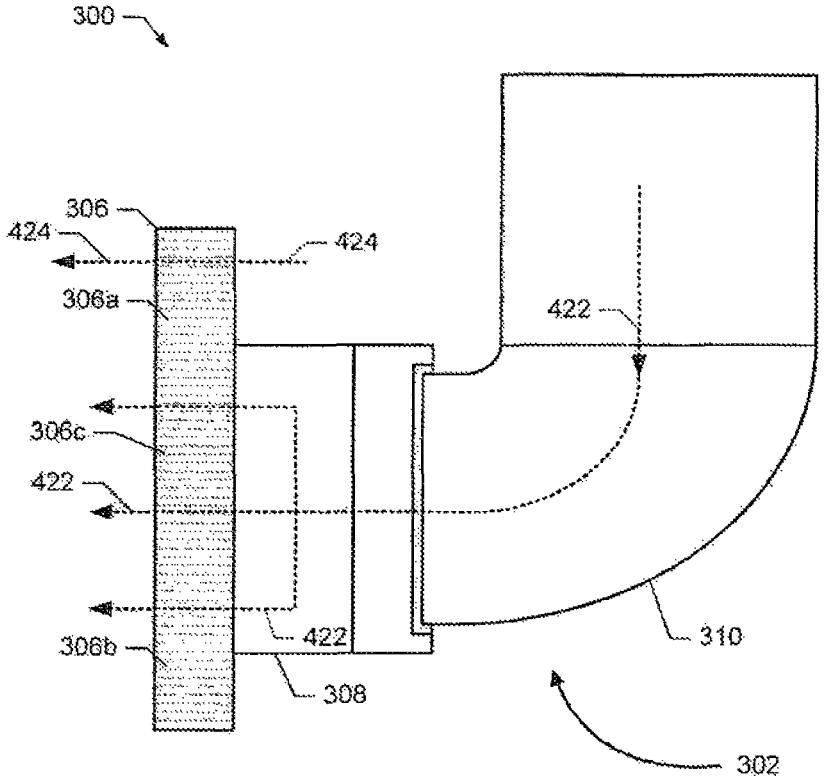
FIG. 4 is a top partial view of the recirculation system 300 in an example embodiment of the invention.

FIG. 4 is a top partial view of the recirculation system 300 in an example embodiment of the invention. The partial view of recirculation system 300 shows the two parts (308 and 310) of duct 302 in the closed/joined position. Condenser 306 receives two different airflows. The first airflow is directed towards condenser 306 from duct 302, and passes through the center section 306*c* of condenser 306. A second airflow passes through the two sides (306*a* and 306*b*) of the condenser. The first airflow 422 is drawn through hood 206, positioned near the transfer member 202, and contains a high concentration of ink carrier vapor. The second airflow 424 is heated air from other internal areas in the printer. The second airflow 424 has a much lower concentration of ink carrier vapor compared to the first airflow 422. Duct 302 prevents the first and second airflows from mixing until they have passed through condenser 306. Once the two airflows pass through the condenser 306 the two cooled airflows are allowed to mix together. The cooled air can then be recycled through the printer.

As the first airflow 422 passes through the condenser the air is cooled and at least part of the ink carrier vapor is condensed into a liquid. The liquid ink carrier is collected and may be recycled. The liquid ink carrier may contain water that was also condensed from water vapor in the first airflow. The amount of ink carrier condensed from the first airflow is dependent on a number of variables including: the ink carrier vapor concentration in the first airflow, the temperature of the first airflow, the temperature of the condenser, the flow rate of the first airflow, and the geometry of the condenser. In general, the higher the concentration of ink carrier vapor in the first airflow, the more efficient the condenser becomes.

The concentration of ink carrier vapor in the air near the transfer member 202 is dependent on a number of factors including: the amount of ink coverage in an image to be printed on the page, the ratio of ink/carrier to be placed on the page and the process speed. A page that contains a full-page continuous tone image will generally require more ink than a page that only contains text. The more ink required for a page corresponds to a larger amount of carrier. When printing a large number of pages with the same image, the ink carrier vapor concentration in the air near the transfer member 202 may remain fairly constant for a given airflow through duct 302. When the image printed on a page varies from page to page, the ink carrier vapor concentration in the air near the transfer member 202 may change rapidly for a given airflow through duct 302.

The controller in the printer can determine the amount of ink that each page will require, the process speed and the ratio of ink/carrier to be placed on the page. Using this information, the controller determines the amount of liquid carrier that will be used during the print operation for each page to be printed. The controller can adjust the fan speed of a variable speed fan coupled to duct 302 such that the concentration of ink carrier vapor near the duct entrance (i.e. the hood 206) remains above a threshold value or within a certain value range.

In one example embodiment of the invention, there may be only one fan used to move air past the condenser. For example, a single fan may be located to the left of the condenser (in FIG. 4) and have a diameter that matches the width (or height) of the condenser. In this example, the single fan would be a variable speed fan and the speed of the fan would be adjusted to keep the concentration of ink carrier vapor above a threshold value. In other embodiments, there may be multiple fans used to move air past the condenser. For example, one fan may be inside duct 302 and another fan may be outside duct 302. The fan inside duct 302 would be a variable speed fan used to move the air and ink carrier vapor mixture from the hood area into the condenser. The speed of the fan inside duct 302 would be controlled such that the concentration of ink carrier vapor would remain above a threshold value. The fan outside the duct 302 may also be a variable speed fan, where the speed of the fan would be adjusted to help maintain a given temperature inside the printer. The fan can be any type of air moving device.

Figure 5:
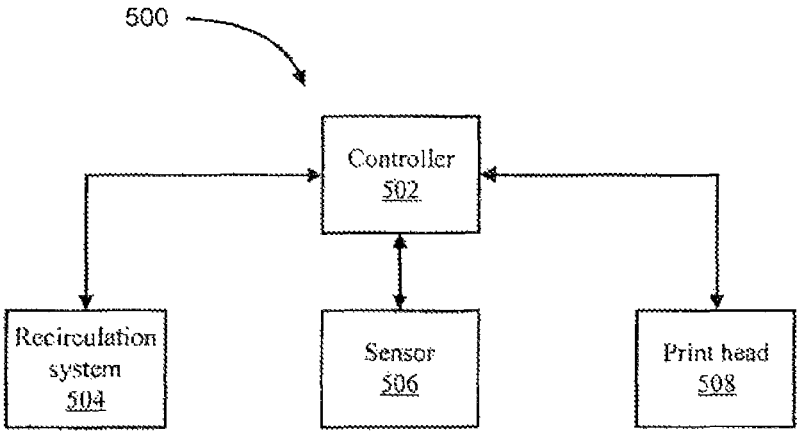
FIG. 5 is a simplified block diagram of a printer 500 in an example embodiment of the invention.

FIG. 5 is a simplified block diagram of a printer 500 in an example embodiment of the invention. Printer 500 comprises a controller 502, a recirculation system 504, a sensor 506, and a print head 508. The controller 502 is coupled to and controllers the recirculation system 504, the sensor 506 and the print head 508. Sensor 506 is located near print head 508 and senses the concentration of ink carrier vapor near print head 508. Recirculation system is configured to remove an air and ink carrier vapor mix from the print head area and condense the ink carrier vapor back into a liquid. The recirculation system has at least one variable speed fan such that the flow rate of the ink carrier vapor and air mixture through the recirculation system can be controlled.

During operations the controller 502 directs the print head 508 to print pages onto media. The controller 502 can determine an amount of liquid carrier that will be used to print the page. The controller 502 will change the speed of the fan in the recirculation system 504 dependent on the amount of liquid carrier to be used to print the page. Controller 502 adjusts the speed of the fan to maintain the ink carrier vapor concentration above a first threshold value. If the ink carrier vapor concentration falls below the first threshold value, the efficiency of the condenser system is reduced. Controller 502 also monitors the concentration of ink carrier vapor near print head 508 using sensor 506. If the concentration of ink carrier vapor exceeds a second threshold, the controller increases the fan speed to a maximum speed to reduce the ink carrier concentration to below the second threshold. The second threshold is used to prevent the ink carrier concentration from reaching a lower explosive limit. The second threshold value is typically set at ¼ the lower explosive limit.

Because the controller has determined the amount of liquid carrier that will be used to print a page before the page will be printed, the controller may adjust the speed of the variable speed fan before the start of the printing operation for a page, just at the start of the printing operation for a page, or sometime after the start of the printing operation for a page. An averaging (or maximal) value per numerous pages can be conducted upon the rate of changing the fan speed.

Figure 6:
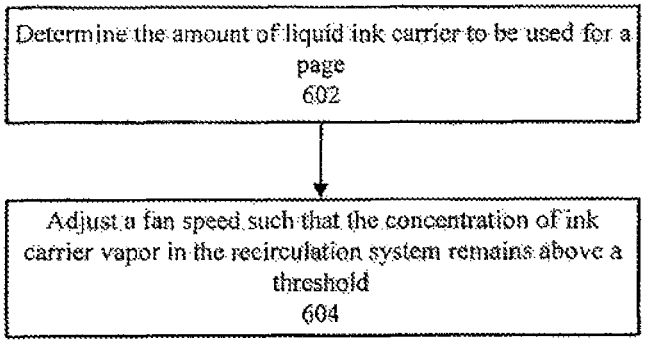
FIG. 6 is a flow chart for a method of operating a recirculation system inside a printer in an example embodiment of the invention.

Controller may comprise one or more processors, memory, logic, for example an application specific integrated circuit (ASIC), and the like. The processors may execute code that causes printer 500 to complete the steps of a method for operating a recirculation system inside the printer. FIG. 6 is a flow chart for a method of operating a recirculation system inside a printer in an example embodiment of the invention. At step 602 an amount of liquid carrier that will be used to print a page is determined. At step 604 the fan speed in a recirculation system inside the printer is adjusted such that the concentration of ink carrier vapor inside the recirculation system remains above a first threshold.

What is claimed is:

1. A carrier recirculation system for a printer, comprising:

a controller to determine an amount of liquid ink carrier to be placed on a page during a print operation;

a transfer member to apply ink of the liquid ink carrier to the page during the print operation, at least a portion of the liquid ink carrier to vaporize during the print operation;

an air passageway having an inlet adjacent to a printing area;

a variable speed fan coupled to the air passageway to control an airflow in the air passageway, the variable speed fan to direct the airflow through the air passageway from the inlet to an outlet;

the controller coupled to the variable speed fan, the controller to vary a speed of the variable speed fan based on the determined amount of the liquid ink carrier to be placed on the page; and a condenser coupled to the air passageway, the condenser to liquefy at least some of the vaporized ink carrier.

2. The carrier recirculation system of claim 1, wherein the controller is to vary the speed of the variable speed fan to maintain an ink carrier vapor concentration, near the inlet, above a first threshold.

3. The carrier recirculation system of claim 1, wherein the controller is to determine the amount of the liquid ink carrier to be placed on the page based on an amount of ink coverage in an image to be printed on the page, a ratio of the ink to the ink carrier to be placed on the page, and a process speed.

4. The carrier recirculation system of claim 1, wherein the controller is to vary the speed of the variable speed fan before a start of the print operation or during the print operation.

5. The carrier recirculation system of claim 1, further comprising:

a second fan to force air through an area of the condenser not coupled to the air passageway.

6. The carrier recirculation system of claim 1, further comprising:

a sensor to sense a concentration of ink carrier vapor near the inlet, wherein the controller is to increase the speed of the variable speed fan in response to the concentration of the ink carrier vapor sensed by the sensor being at or above a second threshold.

7. The carrier recirculation system of claim 6, wherein the controller is to increase the speed of the variable speed fan to a predetermined maximum speed in response to the concentration of the ink carrier vapor sensed by the sensor being at or above the second threshold.

8. A method for re-circulating an ink carrier in a printer, comprising:

determining, by a controller, a liquid amount of the ink carrier to be placed on a page during a print operation;

printing an image onto the page using the ink carrier, wherein at least a portion of the ink carrier vaporizes prior to or while the page is being printed;

adjusting, by the controller, a speed of a fan in an ink carrier recirculation system based on the determined liquid amount of the ink carrier to be placed on the page, such that a concentration of the vaporized ink carrier remains above a first threshold.

9. The method of claim 8, wherein the speed of the fan is adjusted during the print operation or prior to the print operation.

10. The method of claim 8, wherein the determining of the liquid amount of the ink carrier to be placed on the page is based on an amount of ink coverage in an image to be printed on the page, and a ratio of ink to the ink carrier to be placed on the page.

11. The method of claim 8, further comprising:

condensing, using a condenser, the vaporized ink carrier into a condensed liquid ink carrier.

12. The method of claim 11, further comprising recycling the condensed liquid ink carrier for use in another print operation of the printer.

13. The method of claim 8, further comprising:

sensing, by a sensor, a concentration of vaporized ink carrier near a printing area; and increasing, by the controller, the speed of the fan in response to the concentration of vaporized ink carrier sensed by the sensor exceeding a second threshold.

14. The method of claim 13, wherein the increasing of the speed of the fan in response to the concentration of vaporized ink carrier sensed by the sensor exceeding the second threshold comprises increasing the speed of the fan to a predetermined maximum speed.

15. The method of claim 11, further comprising:

directing, through a duct, a first airflow containing the vaporized ink carrier to the condenser.

16. The method of claim 15, further comprising:

directing a second airflow outside the duct to the condenser, the second airflow including heated air; and mixing the first and second airflows after passing through the condenser, to produce cooled air.

* * * * *

UNITED STATES PATENT AND TRADEMARK OFFICE

CERTIFICATE OF CORRECTION

PATENT NO. : 9,010,892 B2
APPLICATION NO. : 14/126457
DATED : April 21, 2015
INVENTOR(S) : Ilan Frydman et al.

It is certified that error appears in the above-identified patent and that said Letters Patent is hereby corrected as shown below:

On the title page, in item (75), Inventors, in column 1, line 3, delete "Kfar Herif" and insert -- Kfar Harif --, therefor.

Signed and Sealed this
Fourteenth Day of June, 2016

Michelle K. Lee

Michelle K. Lee
*Director of the United States Patent and Trademark Office*